US005919072A

United States Patent [19]

Pohlman

[11] Patent Number: 5,919,072

[45] Date of Patent: Jul. 6, 1999

[54] CONSTRUCTION TOY SET FOR ASSEMBLING A STEERABLE TOY VEHICLE

[75] Inventor: Joe K. Pohlman, Los Angeles, Calif.

[73] Assignee: Mattel, Inc., El Segundo, Calif.

[21] Appl. No.: 08/796,252

[22] Filed: Feb. 6, 1997

[51] Int. Cl.[6] ..... A63H 33/08

[52] U.S. Cl. ..... 446/95; 446/120; 446/126; 446/94

[58] Field of Search ..... 446/90, 93, 94, 446/95, 120, 125, 126, 460, 469

[56] References Cited

U.S. PATENT DOCUMENTS

| | | | |
|---|---|---|---|
| 1,400,066 | 12/1921 | Huck | 446/126 |
| 1,608,592 | 11/1926 | Funk | 446/126 |
| 3,234,683 | 2/1966 | Christiansen . | |
| 3,604,130 | 9/1971 | Forsstrom . | |
| 3,755,959 | 9/1973 | Boberg . | |
| 4,109,398 | 8/1978 | Hida . | |
| 4,136,482 | 1/1979 | Fischer . | |
| 4,202,132 | 5/1980 | Fischer . | |
| 4,509,929 | 4/1985 | Zawitz | 446/102 |
| 4,599,077 | 7/1986 | Vuillard | 446/85 |
| 4,624,647 | 11/1986 | Munnix | 446/95 |
| 4,631,040 | 12/1986 | Shiraishi | 446/95 |
| 4,690,656 | 9/1987 | Friedman et al. | 446/95 |
| 4,764,143 | 8/1988 | Gat et al. | 446/102 |
| 4,802,876 | 2/1989 | Bertrand | 446/95 |
| 4,813,903 | 3/1989 | Furukawa et al. | 446/90 |
| 5,046,982 | 9/1991 | Erickson | 446/112 |
| 5,069,647 | 12/1991 | Zuviria | 446/127 |
| 5,071,384 | 12/1991 | Poulsen | 446/103 |
| 5,282,767 | 2/1994 | Gelardi | 446/126 |
| 5,310,376 | 5/1994 | Mayuzumi et al. | 446/107 |
| 5,518,434 | 5/1996 | Ziegler | 446/120 |

FOREIGN PATENT DOCUMENTS

| | | | |
|---|---|---|---|
| 2239084 | 3/1975 | France | 446/125 |
| 740659 | 7/1944 | Germany | 446/126 |
| 655184 | 7/1963 | Italy | 446/126 |
| 366230 | 1/1963 | Switzerland | 446/126 |

OTHER PUBLICATIONS

Lego catalog excerpts, dated 1978.

Lego kit 948—Go–Cart Expert Builder Set, Instruction Manual, dated 1978

*Primary Examiner*—Robert A. Hafer

*Assistant Examiner*—Jeffrey D. Carlson

*Attorney, Agent, or Firm*—Roy A. Ekstrand

[57] ABSTRACT

A toy vehicle is fabricated from a plurality of construction toy elements which are commonly coupled by a plurality of interlockable couplers. The basic coupler mechanism utilizes a cube-like body having a plurality of extending flanges and supporting cylindrical bosses which are received within appropriately shaped slots in the various construction toy elements. A plurality of specialty elements are provided which facilitate the fabrication of a steering assembly for use on a toy vehicle or the like. The steering assembly employs a steering wheel having integral gear and a gear rack together with a plurality of pivoting couplers and a combination of interlocking couplers and construction toy elements.

6 Claims, 5 Drawing Sheets

10
12
13
14
15
16
18
20
21
22
23
25
26
30
31
32
33
34
35
36
37
40
41
42
43
44
80
81
82
83
84
85
110
111
112
113
114
115
116
117
118
120
121
122
123
124
125
126
127
128

CONSTRUCTION TOY SET FOR ASSEMBLING A STEERABLE TOY VEHICLE

FIELD OF THE INVENTION

This invention relates generally to construction toys and particularly to a combination of construction toy elements which may be fabricated to form a steerable toy vehicle.

BACKGROUND OF THE INVENTION

Construction toy playsets have been provided in different forms for many decades. Earliest construction toy sets provided a plurality of elongated metal elements together with suitable fastening devices to form various apparatus and play structures. Other early construction toy playsets utilize various elongated elements having end pegs together with coupling elements formed of wood or similar material having plural peg receiving passages allowing the pegged elements to be assembled to form various structures and toy apparatus. Construction toy playsets provide substantial developmental activity for the child user and thus are very well received and appreciated by educators and parents. The challenge for providing construction toy sets which enjoy commercial success is the dual roll of entertainment and amusement on one hand and child developmental skills on the other. In order for the child user to maximize the developmental activity, the user must remain interested in and challenged by the toy playset. The amusement and entertainment aspects of the toy playset provide the primary motivation for use which leads to the desired developmental skills.

Recognizing the enormous success of construction toy sets, practitioners in the art have, through the years, provided a virtually endless variety of such construction sets. Modern construction toy sets utilize large numbers of molded plastic parts which form cooperating interlock or snap-fit attachments to provide maximum flexibility and challenge for the user. As a result, construction toy sets are provided which facilitate assembling a great variety of items ranging from structural dwellings to toy vehicles or the like. In many instances, practitioners provide various specialty items within the plurality of generic construction elements to facilitate the assembly of challenging devices or apparatus.

U.S. Pat. No. 3,234,683 issued to Christiansen sets forth a TOY BUILDING ELEMENT INCLUDING A ROTATABLE BUSHING having plural interlocking building elements which accommodate a rotatable bushing and shaft combination. As a result, structures such as rotatable wheels may provided.

U.S. Pat. No. 5,069,647 issued to Zuviria sets forth a SOLID RECTANGULAR BUILDING BLOCK FOR TOY BUILDING SET having a plurality of block structures defining plural ribs and grooves allowing the blocks to interlock. Additional elements may be secured to the blocks such as wheel shafts or the like to enhance flexibility.

U.S. Pat. No. 5,310,376 issued to Mayuzumi, et al. sets forth a TOY THAT CAN BE ASSEMBLED INDEPENDENTLY BY A CHILD having a planar base member defining a plurality of peg receiving holes therein together with a plurality of coupling elements supporting plural outwardly extending pegs. Elongated flexible elements are interlockably received upon the coupling elements allowing various structures to be fabricated.

U.S. Pat. No. 3,604,130 issued to Forsstrom sets forth a CONSTRUCTION SERIES FOR MOLECULAR MODELS having a plurality of generally spherical interlocking elements which may be assembled to represent various atoms and molecules.

U.S. Pat. No. 4,109,398 issued to Hida sets forth an CONSTRUCTION TYPE EDUCATIONAL AND AMUSEMENT DEVICE having a basic element which defines a generally spherical hollow module or capsule having adjuncts which may be interconnected and operatively assembled into a large number of different configurations to form various apparatus.

U.S. Pat. No. 4,509,929 issued to Zawitz sets forth an ANNULAR SUPPORT DEVICE WITH PIVOTAL SEGMENTS having a plurality of torus segments interconnectable end to end to form an annular loop in which each segment is independently pivotal to form various shapes.

U.S. Pat. No. 4,631,040 issued to Shiraishi sets forth a CONSTRUCTION TOY SET having a variety of component parts including bases, housings and auxiliary members. Male and female connecting elements attached to the respective components allow for assembly in a variety of configurations.

U.S. Pat. No. 4,764,143 issued to Gat, et al. sets forth ASSEMBLY TOYS FOR JOINING CYLINDRICAL OBJECTS having a plurality of devices for removably connecting a plurality of cylindrical objects. Each device includes apparatus for interconnecting to other devices at a variety of angles and for securing a cylindrical object.

U.S. Pat. No. 5,046,982 issued to Erickson sets forth CONSTRUCTION APPARATUS having a plurality of relatively flat components each having at least three sides. The apparatus further includes an elongated rod-like member extending along each side and in large corner portions between the members. A plurality of connectors are provided for interconnecting adjacent sides of members to form structures.

In many construction sets, apparatus is provided for specialized assembly such as toy vehicles or the like. For example, U.S. Pat. No. 4,802,876 issued to Bertrand sets forth an AXLE STRUCTURE AND AXLE JOINT FOR CONSTRUCTION TOY ASSEMBLY having a base plate, an abutment plate normal to one edge of the base plate, a cross-shaped columnar connector perpendicular to the base plate and a cross-shaped shaft perpendicular to the abutment shape. The shaft defines bulges at its free end and is attachable to the cross-shaped structure.

U.S. Pat. No. 5,071,384 issued to Poulsen sets forth a STEERING MECHANISM for use with toy building sets to assemble devices such as toy vehicles. The mechanism includes rack means and a pinion cooperating therewith.

U.S. Pat. No. 4,690,656 issued to Friedman, et al. sets forth WHEEL AND WINCH ASSEMBLIES utilizing identical hubs and axles in a toy construction set. A special block having a axle projecting therefrom is provided and a hub mechanism is receivable upon the shaft to support a resilient tire.

U.S. Pat. No. 4,599,077 issued to Vuillard sets forth a MODULAR TOY while U.S. Pat. Nos. 4,202,132 and 4,136,482 both issued to Fischer set forth interacting structural elements generally related to construction toy sets.

While the foregoing described prior art devices have improved the art generally and have in some instances enjoyed commercial success, there remains nonetheless a continuing need in the art for evermore improved, interesting and challenging construction toy sets.

SUMMARY OF THE INVENTION

Accordingly, it is a general object of the present invention to provide an improved construction toy set. It is a more particular object of the present invention to provide an improved construction toy set which facilitates assembling a steerable toy vehicle. It is a still more particular object of the present invention to provide an improved construction toy set which facilitates assembling a steerable toy vehicle having realistic steering action and characteristics.

In accordance with the present invention, there is provided a construction toy set comprising: a first plurality of beam elements each having ends supporting first snap-fit connection elements; a first plurality of couplers each supporting a plurality of second snap-fit connection elements, the first and second snap-fit connection elements cooperating to interconnect the beam elements and the couplers to form a toy vehicle body; and a steering assembly having a plurality of interlockable construction elements having first and second pivotable attachments to the toy vehicle body, a pair of wheel support means, a gear rack, a pair of pivoting couplers for coupling the gear rack to the interlockable construction elements, a rotatable steering wheel supported by the toy vehicle body having a gear engaging the gear rack.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figures 1, 8, 9:
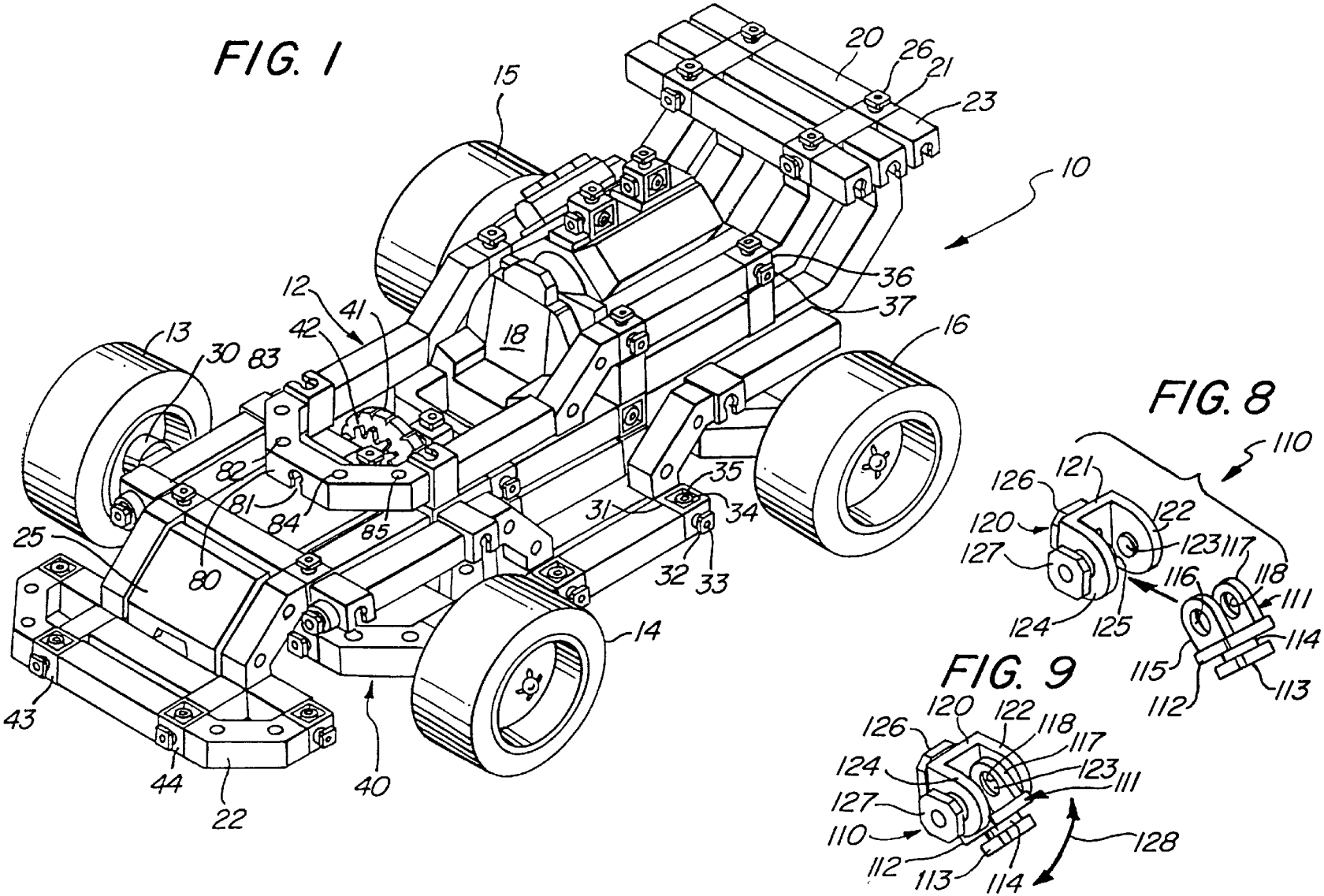
FIG. 1 sets forth a perspective view of a toy vehicle assembled from a construction toy set fabricated in accordance with the present invention.
FIG. 8 sets forth a perspective assembly view of a pivot joint element of the present invention construction toy set during assembly.
FIG. 9 sets forth a perspective view of the pivot joint element of FIG. 8 following assembly.

FIG. 1 sets forth a toy vehicle generally referenced by numeral 10 fabricated using the present invention construction toy set. As is set forth below in greater detail, the present invention construction toy set includes a plurality of basic toy set elements which are used repeatedly in various combinations to facilitate the fabrication of complex structures such as toy vehicle 10. Thus, the present invention construction toy set includes a plurality of elongated generally straight beam elements such as beam element 20 together with a plurality of couplers 21. Additional basic elements of the present invention construction toy set include a plurality of short beams 23 and a plurality of angle elements 22. The majority of toy vehicle 10 is fabricated using plural combinations of these basic toy construction set elements in which the elements are joined and secured to form the toy vehicle basic structure in a snap-fit attachment using coupler elements 21 in the manner set forth below. In addition, a plurality of specialized items are provided which are particularly suited to fabrication of apparatus such as toy vehicle 10. These specialized items include a simulated engine 17, a driver seat 18, and a plurality of generally flat panels 25. Further specialty items include a plurality of wheel mounts such as wheel mount 30 which are operative to couple a plurality of wheels 13 through 16 to vehicle body 12 and complete toy vehicle 10.

In accordance with an important aspect of the present invention, toy vehicle 10 is fabricated using the present invention construction toy set to include a steering assembly generally referenced by numeral 40 which as is set forth below in greater detail supports wheels 13 and 14 in a steerable suspension attachment. In further accordance with the present invention, toy vehicle 10 supports a steering wheel 41 secured within vehicle body 12 and having an integrally formed gear 42. By means set forth below in greater detail, the rotation of steering wheel 41 and gear 42 by the user produces a turning action operative upon wheels 13 and 14 through steering assembly 40.

Thus, in accordance with the present invention, the present invention construction toy set makes use of plural standard items together with a plurality of specialty items which facilitate the fabrication of a toy vehicle such as toy vehicle 10 which includes a steerable front suspension assembly.

To add further variety and flexibility to the present invention construction toy set, a plurality of differently configured couplers are provided. These couplers interlock various basic elements such as beams 20 or 23 as well as specialty items to facilitate the fabrication of apparatus such as toy vehicle 10. The basic interlocking feature of the variously shaped couplers and cooperating structural elements is set forth in FIGS. 2 through 7 in greater detail. Suffice it to note here that the various couplers share the common characteristic of providing a plurality of spaced interlock flanges which facilitate this interlocking construction and fabrication. In addition, the various couplers share the further common characteristic of defining one or more apertures or passages therethrough. This provides still greater flexibility in facilitating the insertion of an axle or shaft to further increase the flexibility of the construction set. By way of example, coupler 21 is illustrative of a cube-like coupler having six facets each of which supports a flange such as flange 26. Coupler 36 supporting a plurality of interlock flanges such as flange 37 provides further example of the basic six-sided coupler. Coupler 31 is exemplary of an alternate configuration of the basic couplers used in the present invention construction toy set and differs somewhat from couplers 21 and 36. Coupler 31 defines four facets upon a cube-like body each supporting an interlock flange such as flange 32. Each of the interlock flanges defines an aperture or passage such as aperture 33 shown in flange 32. Couplers such as coupler 31, however, differ from the "six-sided" couplers represented by couplers 21 and 36 in that the top and bottom sides support a center boss such as boss 34 through which a passage 35 is formed. The provision of a center boss through the coupler and the passage extending therethrough further enhances the flexibility of the coupler and enables the support of a rotatable shaft or use of the coupler in situations in which an extending flange on the top and bottom surfaces would be undesirable aesthetically or operationally as seen for example in couplers 43 and 44.

As may be seen by examining FIG. 1, a plurality of angle elements such as angle element 22 are used repeatedly throughout toy vehicle 10 and facilitate interesting structural configurations. An additional element which provides great flexibility of use for the construction toy set is found in bridge element 80 which defines a center notch 81 having an interlock configuration for receiving a coupler together with a plurality of passages 82 through 85 formed therein. In addition, bridge element 80 defines interlock notches at the end portion thereof which are not visible in FIG. 1 due to the perspective view but which will be understood to be standard interlock notches such as notch 81 which facilitate attachment to a flange coupler in the manner shown in FIGS. 2 through 7.

Of particular importance to the present invention is the ability of the construction toy set to fabricate a steering assembly such as steering assembly 40. The structure of steering assembly 40 and its operation is set forth below in FIGS. 10 through 13. However, suffice it to note here that steering assembly 40 is secured to vehicle body 12 using the various interlocking elements and is fabricated using such basic elements together with a plurality of specialty elements described below. It will be apparent to those skilled in the art that the steering assembly of the present invention is readily secured to differently configured toy vehicles. However, toy vehicle 10 has been found to be particularly advantageous in utilizing the steering assembly of the present invention system.

Figures 2, 3, 4, 5, 6, 7:
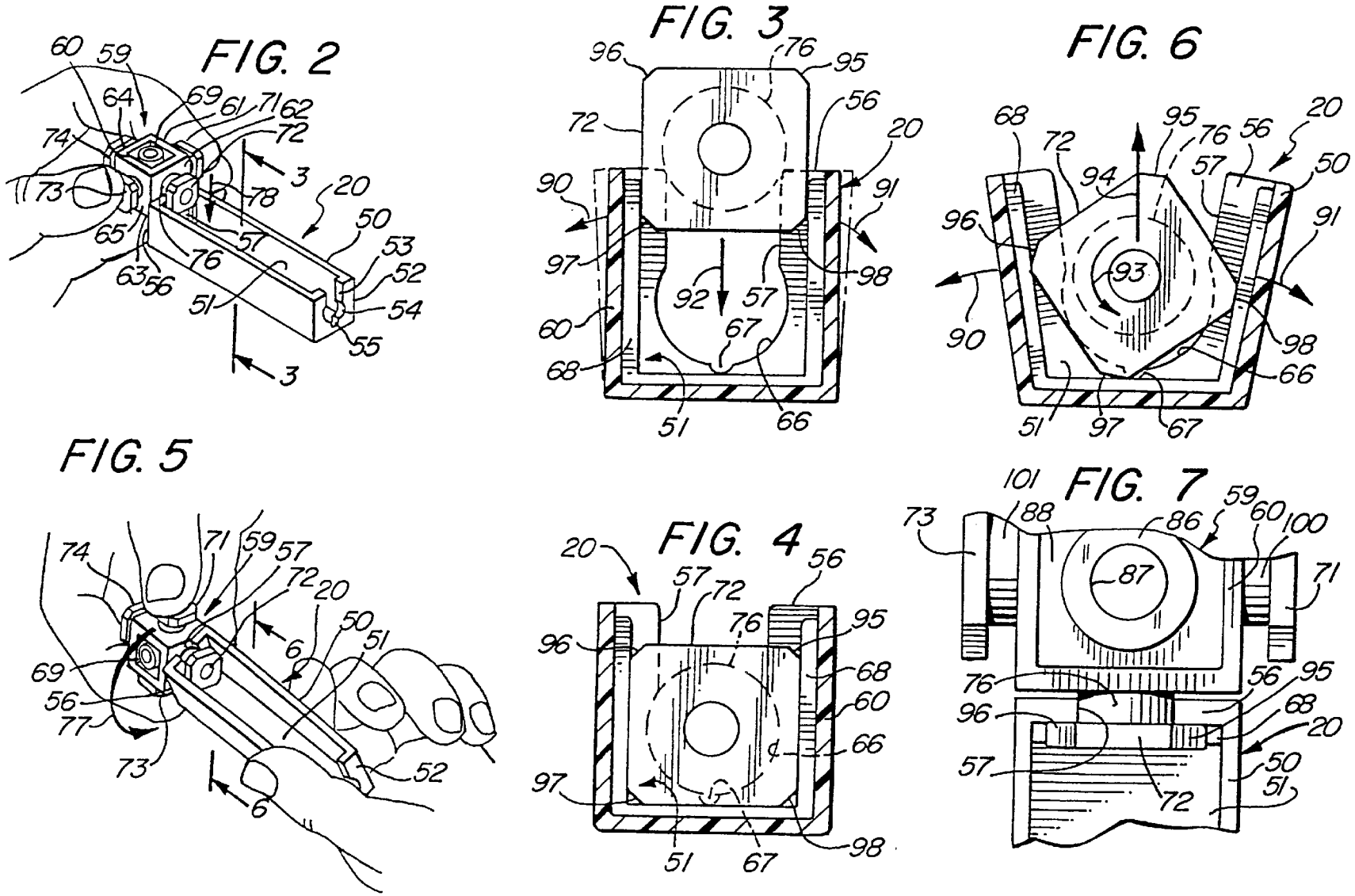
FIG. 2 sets forth a perspective assembly view of the assembly of a basic construction set element and its cooperating coupling element.
FIG. 3 sets forth a section view showing the initial assembly of the construction element and coupling element taken along section lines 3—3 in FIG. 2.
FIG. 4 sets forth a section view taken along section lines 3—3 in FIG. 2 showing the coupling element and construction toy element assembled.
FIG. 5 sets forth a perspective view of a coupling element and construction toy element during the disassembly process.
FIG. 6 sets forth a section view taken along section lines 6—6 in FIG. 5 showing the initial step in disassembling the coupling element from the construction set element therein.
FIG. 7 sets forth a partial top view of the assembled coupling element and construction set element shown in FIG. 5.

FIG. 2 sets forth a perspective assembly view showing the interlocking attachment of a typical coupler 59 to a typical beam element 20. As described above, beam element 20 defines an elongated generally rectangular body 50 having opposed ends 52 and 56. Beam element 20 is essentially three-sided having three mutually perpendicular generally planar sides extending between ends 52 and 56 and an open side and interior channel 51. Ends 52 and 56 are identical and define the basic attachment feature which cooperates with coupler 59 in a snap-fit assembly. Thus, end 52 defines a slot 53 and a circular notch 54. Beneath notch 54, a relief notch 55 is also formed. As is better seen in FIG. 6, relief notch 55 facilitates the separation of slot 53 and notch 54 during the removal and attachment of an element such as coupler 59. Correspondingly, end 56 which is identical to end 52 defines a slot 57, a circular notch 66, and a relief notch 67 (better seen in FIG. 3).

Coupler 59 is a typical coupler such as coupler 31 shown above in FIG. 1 and defines a generally cubic body 60 having four planar sides or facets 61 through 64. In addition, cubic body 60 defines open sides on the top and bottom within the interior of which a cylindrical boss 69 is formed. Facets 61 through 64 support outwardly extending cylindrical bosses such as boss 76 extending from facet 62. A corresponding plurality of generally rectangular flanges 71 through 74 are supported in a spaced relationship from facets 61 through 64 respectively. The spacing of flanges 71 through 74 from their respective supporting faces 61 through 64 of coupler 59 facilitates the insertion of coupler 59 into a snap-fit attachment with a cooperating element such as beam element 20.

The attachment of coupler 59 to beam element 20 illustrated in FIGS. 2, 3 and 4 as well as the removal or separation of that attachment illustrated in FIGS. 5 and 6 is typical of the interconnection of elements within the present invention construction toy set. Thus, with temporary reference to FIG. 11, it will be noted that the present invention construction set utilizes pluralities of couplers such as coupler 59 to interconnect various structural elements such as beam element 20 as well as specialty items to facilitate the fabrication of an apparatus such as toy vehicle 10 shown in FIG. 1. Accordingly, the descriptions which follow in combination with FIGS. 2 through 6 should be understood to apply generally to the various structural attachments and connections shown throughout the remainder of the construction toy set.

Returning to FIG. 2, coupler 59 is shown being attached to beam element 20. In this attachment, cylindrical boss 76 of coupler 59 is aligned with slot 57 of beam element 20 which causes end 56 of beam element 20 to be positioned between facet 62 and flange 72. Thereafter, the coupler is forced downwardly as indicated by arrow 78 to force cylindrical boss 76 through slot 57 to be received within circular notch 66. During this insertion process, the elastic material of beam element 20 facilitates a spreading of slot 57 to allow boss 76 to pass into notch 66. Thereafter, the resilient material of body 50 maintains a snap-fit attachment. It will be apparent to those skilled in the art that flanges 71, 73 and 74 could alternatively be secured to beam element 20 in this manner. It will be further apparent to those skilled in the art that a similar coupler to coupler 59 may be secured to end 52 of beam element 20 in a similar fashion.

FIGS. 3 and 4 set forth respective partial section views of the insertion of coupler 59 into beam element 20. In the preferred fabrication of the present invention construction toy set, the various structural elements and couplers as well as the specialty items are preferably formed of a somewhat resilient material such as molded plastic or the like. This resilience facilitates the snap-fit adjustment illustrated in FIGS. 2 through 4. With specific reference to FIG. 3, flange 72 supported by boss 76 defines a plurality of corner facets 95 through 98 which operate in the manner set forth in FIGS. 5 and 6 to facilitate removal of the coupler from an element such as beam element 20. Beam element 20 defines an end 56 having a slot 57 and a circular notch 66 together with a relief notch 67 formed therein. As described above, beam element 20 defines a three-sided open faced elongated rectangular element having an interior channel 51 extending between the respective ends thereof. Beam element 20 further defines a generally U-shaped rib 68 positioned against the interior corner of end 56 within interior channel 51 of beam element 20. Assembly is carried forward by positioning cylindrical boss 76 in alignment with slot 57 such that flange 72 extends into interior channel 51 and is received between opposed sides of rib 68. Thereafter, coupler 59 is forced into interior channel 51 in the direction indicated by arrow 92. Because the diameter of boss 76 is slightly larger than slot 57, the resilient material of beam element 20 is deformed slightly as coupler 59 is forced downwardly. This deformation takes the form of a resilient opening of the sides of beam element 20 in the directions indicated by arrows 90 and 91. As the sides of beam element 20 flex outwardly, boss 76 passes through slot 57 and is received within notch 66. The travel of boss 76 into notch 66 allows the elastic return of beam element 20 to its natural shape captivating boss 76 within notch 66. Relief notch 67 facilitates the flexing of beam element 20 during this process.

FIG. 4 sets forth the assembled or coupled position of coupler 59 to beam element 20. As can be seen, flange 72 of coupler 59 is received within the three-sided enclosure of rib 68 and is thus maintained in a non-rotational attachment. As may also be seen, cylindrical boss 76 of coupler 59 is captivated within notch 66 and held therein by the resilient character of beam element 20. At this point, the attachment or coupling of coupler 59 to beam element 20 is complete.

FIG. 5 sets forth a perspective view of the initial operation of removing coupling 59 from beam element 20. Thus, coupler 59 having flanges 71 through 74 and a center boss 69 is grasped firmly by the user in one end while the remaining hand grasps beam element 20. As described above, beam element 20 includes a body 50 preferably formed of a resilient molded plastic material defining an interior channel 51 and opposed end 56 and 52. In the initial step of disassembly, coupler 59 is rotated with respect to beam element 20 in either direction. For purposes of illustration, FIG. 5 shows coupler 59 rotated in the direction indicated by arrow 77.

FIG. 6 sets forth a section view taken along section lines 6—6 in FIG. 5 showing the initial step of coupler element removal illustrated in FIG. 5. As described above, beam element 20 defines a three-sided elongated rectangular body 50 having a U-shaped rib 68 formed therein. Beam element 20 also includes an end 56 having a slot 57 and a notch 66 formed therein. A relief notch 67 is also formed in end 56 of beam element 20. Coupler 59 includes a flange 72 supported by a cylindrical boss 76. Flange 72 further defines corner facets 95 through 98 at each corner of the square flange. As the above-described rotation of coupler 59 with respect to beam element 20 takes place, flange 72 is rotated in the direction indicated by arrow 93. As a result, facets 96 and 98 are forced against opposed sides of rib 68 while facet 97 is forced against the bottom side of rib 68. The resilient material of beam element 20 allows the sides of the beam element to flex outwardly in the directions indicated by arrows 90 and 91 which releases boss 76 from its captivation within notch 66. Thereafter, with flange 72 maintained in the rotational position shown in FIG. 6, coupler 59 may be withdrawn outwardly in the direction indicated by arrow 94 and removed from its attachment to beam element 20. Once coupler 59 is removed, the resilient material of body 50 allows beam element 20 to return to its normal shape.

FIG. 7 sets forth a partial top view of an installed attachment between coupler 59 and beam element 20. As described above, coupler 59 includes a plurality of facets each supporting a respective cylindrical boss. In FIG. 7, cylindrical bosses 100 and 101 are shown on opposed sides of body 60 supporting flanges 71 and 73 respectively. Similarly, boss 76 extends outwardly from body 60 and supports a flange 71 in a spaced relationship. Flange 72, it will be recalled, defines a plurality of corner facets such as facets 95 and 96. Beam element 20 defines an end 56 which in turn defines a slot 57. As is seen above, end 56 of beam element 20 also defines a notch 66 which receives boss 76 in the above-described attachment. Flange 72 is spaced from body 60 of coupler 59 so as to receive end 56 in the above-described attachment. Rib 68 extends inwardly into interior channel 51 of body 50 to provide nonrotational attachment of flange 72. It will be understood that the attachment between coupler 59 and beam element 20 shown in FIG. 7 is typical of the snap-fit attachments utilized in the present invention construction toy set.

FIGS. 8 and 9 illustrate a specialty coupler utilized in fabricating the steering assembly for toy vehicle 10 in accordance with the present invention. FIG. 8 shows an assembly view of the pivoting coupler while FIG. 9 shows the coupler fully assembled. The important aspect of the specialty coupler shown in FIGS. 8 and 9 is its ability to provide pivotal motion between respective elements such as beam elements or the like which are secured to each portion of the coupler.

With specific reference to FIG. 8 in which an assembly view of coupler 110 is shown, coupler 110 includes a coupler portion 111 having a planar body 112 supporting a pair of spaced apart tabs 115 and 117. Tabs 115 and 117 define respective apertures 116 and 118 extending therethrough. In addition, body 112 includes a cylindrical boss 114 supporting a coupler flange 113. Flange 113 is substantially identical to flange 72 shown on coupler 59 in FIGS. 2 through 7. Thus, flange 113 and boss 114 facilitate snap-fit assembly of coupler portion 111 to standard elements within the present invention construction toy set such as beam elements 20 or 23 (seen in FIG. 1).

Coupler 110 further includes a coupler portion 120 having a generally U-shaped body 121 defining a pair of spaced apart plates 122 and 124. The interior spacing of plates 122 and 124 is sufficient to receive tabs 115 and 117 between plates 122 and 124. Plate 122 defines an inwardly extending cylindrical boss 123 while plate 124 defines a similar inwardly extending cylindrical boss 125. The diameters of bosses 123 and 125 are selected to facilitate insertion of the bosses into apertures 116 and 118 of coupler portion 111. Body 121 further supports a pair of coupler flanges 126 and 127 upon cylindrical bosses in a spaced arrangement substantially identical to the support of coupler flanges shown above on coupler 59. Thus, coupler portion 120 is also capable of snap-fit assembly to the various elements of the construction toy set such as beam elements 20 and 23 shown in FIG. 1.

The assembly of coupler 110 is carried forward by forcing tabs 115 and 117 inwardly and inserting the tabs between bosses 125 and 123. In its preferred form, coupler 110 is fabricated of a resilient material such as molded plastic or the like. Accordingly, when tabs 115 and 117 are released, bosses 125 and 123 are received within apertures 116 and 118 respectively to provide a pivotal attachment between coupler portions 111 and 120.

FIG. 9 sets forth coupler 110 in the fully assembled configuration. Thus, coupler 110 includes a coupler portion 111 pivotally secured to a coupler portion 120 by the engagement of bosses 125 and 123 within apertures 116 and 118 of tabs 115 and 117. Accordingly, coupler portions 111 and 120 are pivotable and, as a result, elements coupled to flange 113 of coupler portion 111 and flanges 126 and 127 of coupler portion 120 are similarly pivotable with respect to each other. As a result, a substantial increase in flexibility of the construction toy set is provided. Of particular importance to the present invention, and as is set forth below in FIGS. 10 through 13 in greater detail, pivotable couplers such as coupler 110 facilitate fabrication of the present invention steering assembly within vehicle 10.

Figure 10:
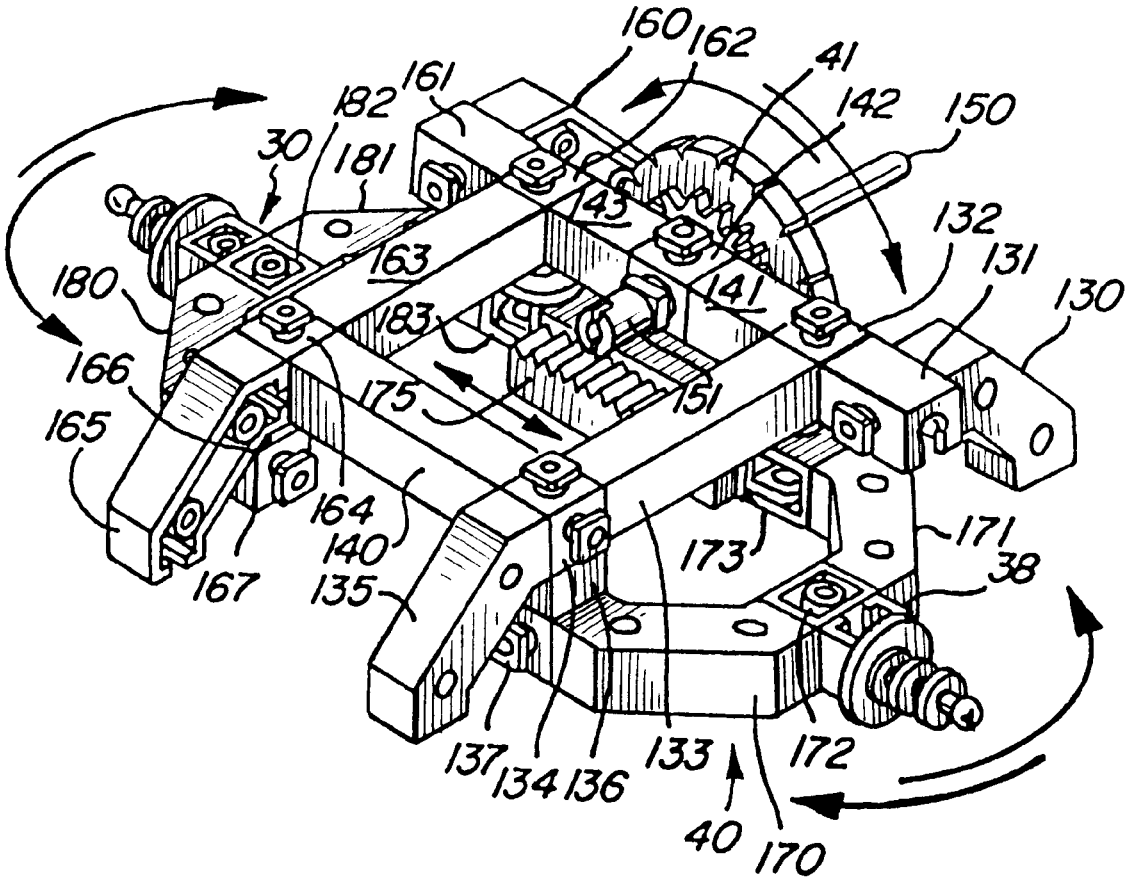
FIG. 10 sets forth a perspective view of the toy vehicle steering combination constructed in accordance with the present invention.

FIG. 10 sets forth a perspective view of a portion of vehicle 10 supporting steering assembly 40 in accordance with the present invention. The structure of toy vehicle 10 is set forth above in FIG. 1. Suffice it to note here that the portion of toy vehicle 10 shown in FIG. 10 is that portion which is used in supporting the present invention steering assembly. Thus, it will be apparent to those skilled in the art that steering assembly 40 may be utilized in differently configured vehicles and that toy vehicle 10 shown in FIG. 1 should be understood to be merely representative of a variety of toy vehicles which may benefit from the present invention steering assembly. Accordingly, an angle element 130 is secured to a short beam 131 which in turn is secured to a coupler 132. A beam element 133 is secured to coupler 132 and extends forwardly to a coupler 137. Coupler 137 is secured to a spacer 136 extending downwardly from coupler 134 and a forwardly extending angle element 135. A similar structure is provided by angle element 160 coupled to a short beam 161 and a coupler 162. Coupler 162 is coupled to beam element 163 which in turn is coupled to a coupler 164. The latter is coupled to a downwardly extending spacer 166 and a forwardly extending angle element 165. Beam elements 133 and 163 are maintained in a parallel spaced apart arrangement by a beam element 135 coupled between couplers 137 and 167 together with the serial combination of a pair of short beam elements 141 and 143 having a coupler 142 therebetween. Short beam elements 141 and 143 are coupled to couplers 132 and 162 respectively.

The combination of construction toy elements 130 through 135 and elements 160 through 165 together with beam element 135 and the combination of short beam elements 141 and 143 together with coupler 142 form the supporting portion of toy vehicle 10 (seen in FIG. 1) to which steering assembly 40 is secured. Accordingly, it will be apparent to those skilled in the art that different support structures may be utilized within the frame and chassis of the host vehicle for employing the present invention steering assembly.

Steering assembly 40 includes a pair of angle elements 170 and 171 commonly coupled to a coupler 172. Angle element 170 is further coupled to a coupler 137 while angle element 171 is further coupler to a pivoting coupler 173. Coupler 173 should be understood to be fabricated in accordance with the structure set forth above in FIGS. 8 and 9 for coupler 110. The remaining side of coupler 173 is coupled to one end of a gear rack element 175. Gear rack element 175 defines a plurality of upwardly extending gear teeth 176. A spacer 136 couples coupler 137 to coupler 134 to support one side of steering assembly 40. The remaining side of steering assembly 40 forms a mirror image of the structure thus far described and includes a pair of angle couplers 180 and 181 commonly coupled to a coupler 182. The remaining end of angle element 180 is coupled to coupler 167 while the remaining end of element 181 is coupled to one side of a pivoting coupler 183. Once again, it will be understood that pivoting coupler 183 is substantially identical to the structure set forth above for coupler 110 in FIGS. 8 and 9. The remaining side of coupler 183 is secured to gear rack 175. A spacer 166 is coupled between coupler 164 and coupler 167 to provide the support for the right hand side of steering assembly 40.

Figure 11:
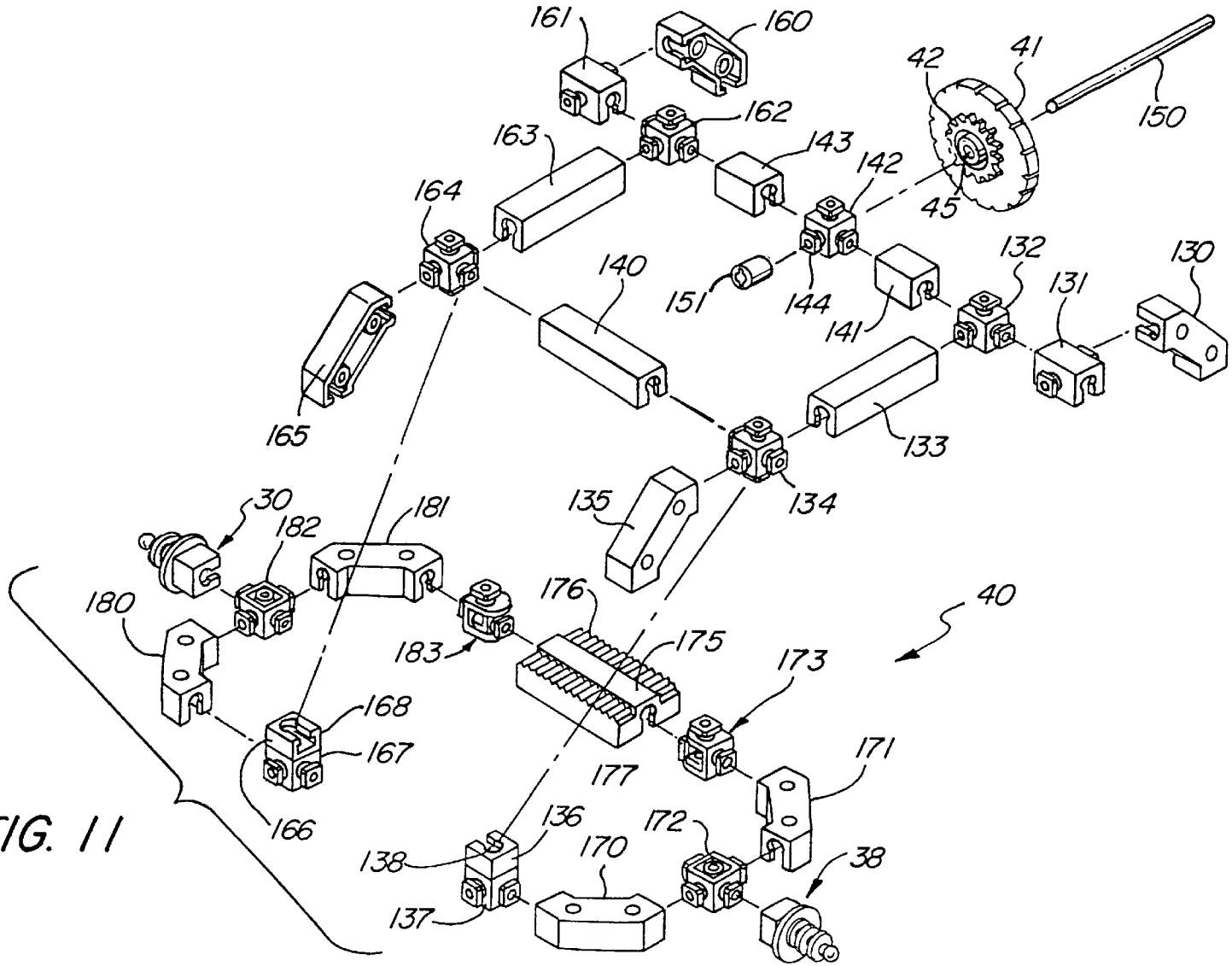
FIG. 11 sets forth a perspective assembly view of the toy vehicle steering combination of FIG. 10.

As is better seen in FIG. 11, spacers 136 and 166 define respective slots 138 and 168 for receiving the downwardly extending flanges of couplers 134 and 164. Because the structures of spacers 136 and 166 do not include a rib structure similar to rib 68 seen in FIG. 3, the resulting attachment between couplers 134 and 164 and spacers 136 and 166 respectively forms a rotatable or pivotable coupling which allows spacers 136 and 166 to pivot with respect to couplers 134 and 164. It will be understood that the pivotal movement of spacers 136 and 166 in turn facilitates the pivotal motion of couplers 137 and 167 together with angle elements 170 and 180 respectively.

An elongated shaft 150 extends through aperture 144 formed in coupler 142 (seen in FIG. 11) and receives a hollow sleeve 151. Sleeve 151 is secured in a high friction "force-fit" which allows sleeve 151 to maintain the position of shaft 150. The intermediate portion of shaft 150 receives and supports the combined structural element of steering wheel 41 and gear 42 in a rotational attachment using the extension of shaft 150 through aperture 45 (seen in FIG. 11). The relative positions of gear rack 175 and steering wheel 41 provide engagement of gear 42 with teeth 176 of gear rack 175. Thus, rotation of steering wheel 141 produces a corresponding lateral movement of gear rack 175.

Steering assembly 40 further includes a pair of wheel mounts 30 and 38 secured to couplers 182 and 172 respectively. The function of wheel mounts 30 and 38 provides rotational support for front wheels 13 and 14 (seen in FIG. 1). The structure of wheel mounts 30 and 34 is set forth in greater detail in the above-described related application. Suffice it to note here that a pair of front wheels 13 and 14 are received upon and supported by wheel mounts 30 and 38.

In operation, rotation of steering wheel 41 in either direction from the center position shown in FIG. 10 produces lateral motion of gear rack 175 which in turn produces pivotal motion of wheel mounts 30 and 38 in the manner set forth below in greater detail. Suffice it to note here that steering assembly 40 converts the rotational motion of steering wheel 41 to pivotal motion of wheel mounts 30 and 38 to provide vehicle steering.

FIG. 11 sets forth a perspective assembly view of steering assembly 40 and the supporting structure of toy vehicle 10 set forth in FIG. 10. As described above, the support structure within vehicle 10 includes an angle element 130 coupled to a short beam element 131 which in turn is secured to a coupler 132. Coupler 132 is secured to a beam element 133 and a short beam element 141. A coupler 134 is secured to beam element 133 and supports a forwardly directed angle element 135. A beam element 140 is secured between coupler 134 and a coupler 164. The latter is coupled to an angle element 165 and a beam element 163. A coupler 162 couples beam element 163 to a short beam element 161 which in turn is coupled to an angle element 160. A coupler 142 is secured between couplers 132 and 162 by short beams 141 and 143 and defines an aperture 144 therethrough. An elongated shaft 150 extends through aperture 144 and is capped by a resilient sleeve 151. The remaining end of shaft 150 receives aperture 45 of steering wheel 41 to rotatably support the steering wheel. A gear 42 is integrally formed with steering wheel 41.

A pair of spacer elements 136 and 166 are secured to the undersides of couplers 134 and 164 in a pivotable or rotatable attachment. A pair of couplers 137 and 167 are secured to the undersides of spacers 136 and 166. An angle element 170 is secured to coupler 137 while an angle element 180 is secured to coupler 167. A pair of couplers 172 and 182 are secured to angle elements 170 and 180 respectively. A pair of wheel mounts 38 and 30 are secured to couplers 172 and 182 respectively. A pair of angle elements 171 and 181 are secured to couplers 172 and 182 respectively and are further coupled to pivoting couplers 173 and 183 respectively. A gear rack 175 defines a plurality of gear teeth 176 in a linear arrangement. Gear rack element 175 further defines a pair of opposed end slots such as slot 177 to facilitate coupling to pivoting couplers 173 and 183 at each end.

Figure 12:
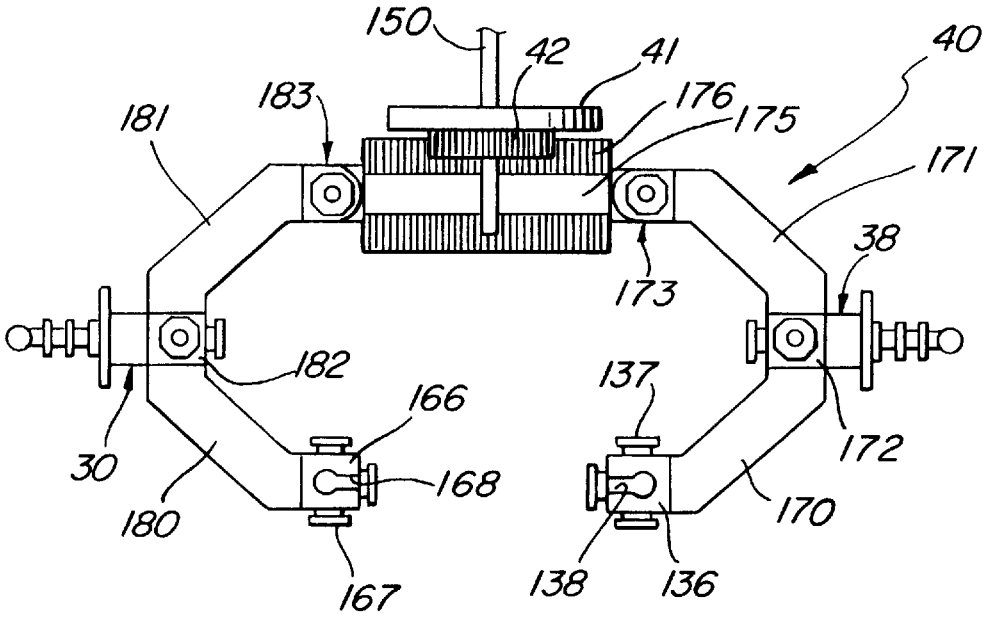
FIG. 12 sets forth a top plan view of a portion of the toy vehicle steering combination of FIG. 10 configured for straight line travel.
Figure 13:
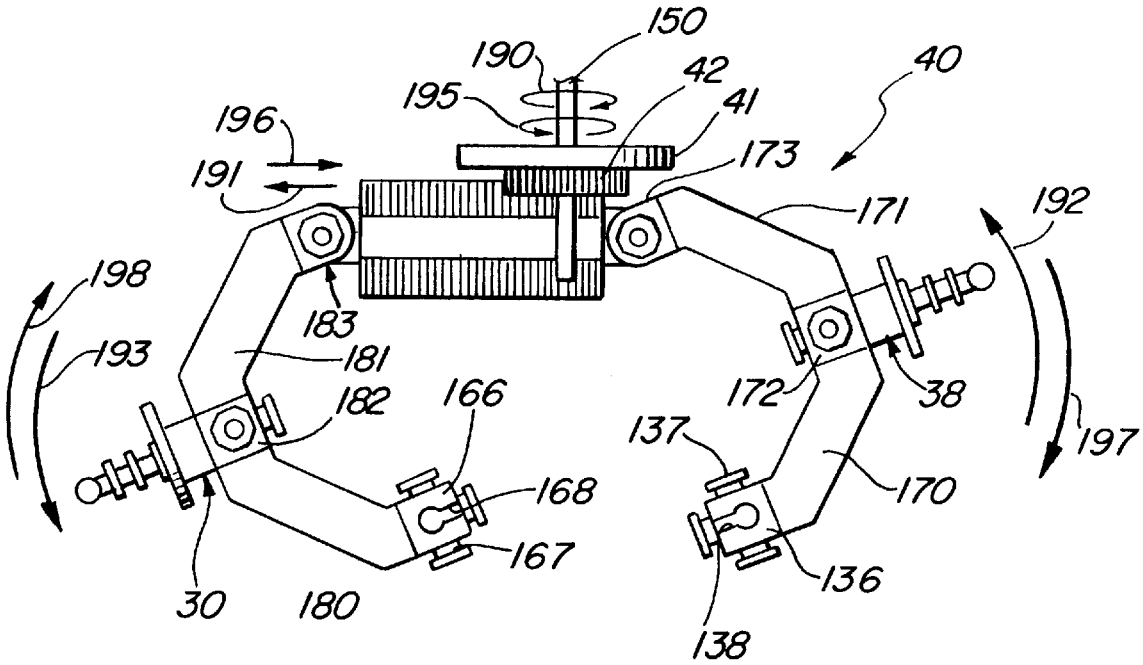
FIG. 13 sets forth a top plan view of a portion of the toy vehicle steering combination of FIG. 12 configured to execute a left turn.

FIGS. 12 and 13 set forth simplified top views of steering assembly 40 with the chassis support pieces described above being omitted to better illustrate the action of steering assembly 40. FIG. 12 shows steering assembly 40 in a straight line travel or centered configuration while FIG. 13 shows steering assembly 40 in the configuration resulting from steering in a left turn direction.

With simultaneous reference to FIGS. 12 and 13, and as is described above, steering assembly 40 includes a gear rack 175 having a plurality of gear teeth 176. A shaft 150 supports a steering wheel 41 having an integrally formed gear 42 which engages teeth 176. Gear rack 175 is coupled to a pair of pivoting couplers 173 and 183 which in turn are coupled to respective angle elements 171 and 181. A pair of couplers 172 and 182 secure elements 171 and 181 to angle elements 170 and 180 respectively. The remaining ends of angle elements 170 and 180 are secured to a pair of couplers 137 and 167 respectively. A pair of spacers 136 and 166 defining respective slots 138 and 168 are coupled to couplers 134 and 164 (seen in FIG. 10) of toy vehicle 10. It will be recalled that the attachment of spacers 136 and 166 to their supporting couplers is a pivotal attachment allowing pivotal motion of spacers 136 and 166. A pair of wheel mounts 38 and 30 are secured to couplers 172 and 182 respectively.

With specific reference to FIG. 12, steering assembly 40 is shown in the center position or straight line travel position in which steering wheel 41 and gear 42 are aligned with the general center of gear rack 175. The resulting configuration is a substantially symmetrical position of steering assembly 40 which maintains wheel mounts 30 and 38 in a straight line travel alignment.

With reference to FIG. 13, steering assembly 40 is shown in the configuration which produces a left hand turn of vehicle 10. As can be seen, steering wheel 41 and gear 42 have been rotated about shaft 150 in the direction indicated by arrow 190. This rotation of steering wheel 41 and gear 42 produces a lateral displacement of gear rack 175 in the direction indicated by arrow 191. The pivotal coupling of couplers 173 and 183 facilitates the lateral movement of gear rack 175 while the pivotal attachment of spacers 136 and 166 to the host vehicle chassis allows each side of steering assembly 40 to pivot. With gear rack 175 displaced in the direction indicated by arrow 191, wheel mount 30 is pivoted in the direction indicated by arrow 193 while wheel mount 38 is pivoted in the direction indicated by arrow 192. In the preferred fabrication of the present invention, the fit of wheel 41 upon shaft 150 is relatively tight and produces substantial friction. This friction tends to maintain any particular rotational setting of wheel 41.

Steering assembly 40 may be returned to the center straight line position of FIG. 12 by rotating steering wheel 41 and gear 42 in the direction indicated by arrow 195. This rotation displaces gear 175 in the direction indicated by arrow 196 which in turn pivots each side of steering assembly 40 about the pivotal attachment at spacers 136 and 166 in the directions indicated by arrows 198 and 197. As the rotation of wheel 41 and gear 42 continues, the steering assembly may be displaced in a right turn configuration by continuing the rotation of steering wheel 41 and gear 42 beyond the centered straight-line position of FIG. 12.

Thus, steering assembly 40 may be set at virtually any steering angle between the travel limits imposed by the length of gear rack 175.

In the preferred fabrication of the present invention construction toy set, the various elements and structural components are preferably fabricated of a molded plastic material or the like which provides some resiliency to facilitate snap-fit attachment while simultaneously providing sufficient rigidity to fabricate various structures such as toy vehicle 10. It will be apparent to those skilled in the art that the combination of basic construction toy elements as well as specialty elements utilized in fabricating the present invention steering assembly provides a combination of structural elements which may be utilized in fabricating other different apparatus thereby increasing the overall flexibility and appeal of the present invention construction toy set. It will be further apparent to those skilled in the art that the fabrication of the present invention steering assembly by the child user employing the various interlockable and connectable structural elements and specialty elements facilitates the child's development in understanding basic mechanics and basic fabrication techniques. Accordingly, what has been shown is a construction toy set for assembling a steerable toy vehicle which greatly enhances the amusement and entertainment value of the construction toy set. The steering assembly provided may be employed with a variety of differently configured vehicles to even further enhance the enjoyment of the present invention construction toy set.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A construction toy set comprising:

a first plurality of beam elements each having ends supporting first snap-fit connection elements;

a first plurality of couplers each supporting a plurality of second snap-fit connection elements, said first and second snap-fit connection elements cooperating to interconnect said beam elements and said couplers to form a toy vehicle body; and a steering assembly having a plurality of interlockable construction elements having first and second pivotable attachments to said toy vehicle body, a pair of wheel support means, a gear rack, a pair of pivoting couplers for coupling said gear rack to said interlockable construction elements, a rotatable steering wheel supported by said toy vehicle body having a gear engaging said gear rack, said plurality of interlockable construction elements including a first pair of couplers, each snap-fit attachable to one of said wheel support means; first and second pairs of angle elements, each pair being snap-fit attachable to one of said couplers in said first pair of couplers to form oppositely extending mirror-image U-shaped portions; a second pair of couplers each coupling one of said angle elements to said pivotable attachments; and a pair of pivoting couplers each pivotably connecting one of said angle elements to said gear rack.

2. A construction toy set as set forth in claim 1 wherein said first and second pivotable attachments each include:

a coupler, within said first plurality of couplers, having a downwardly extending flange; and a spacer, secured to one of said couplers in said second pair of couplers, having an upwardly facing notch for receiving said downwardly extending flange in a rotatable attachment.

3. A construction toy set as set forth in claim 2 wherein said rotatable steering wheel and said gear are integrally formed as a single molded element.

4. A construction toy set as set forth in claim 3 wherein said first and second pairs of angle elements are substantially identical and wherein each angled element defines orthogonal end surfaces having said first snap-fit connection elements formed therein and wherein said couplers in said first and second pair of couplers each defines pluralities of said second snap-fit connection elements.

5. A construction set as set forth in claim 4 wherein said gear rack defines opposed ends each having one of said first snap-fit connection elements formed therein and wherein each of said pivoting couplers in said pair of pivoting couplers includes at least two of said second snap-fit connection elements.

6. A construction toy set comprising:

a first plurality of beam elements each having ends supporting first snap-fit connection elements;

a first plurality of couplers each supporting a plurality of second snap-fit connection elements, said first and second snap-fit connection elements cooperating to interconnect said beam elements and said couplers to form a toy vehicle body; and a steering assembly having, a pair of mirror-image U-shaped steering segments each formed of a center coupler and a pair of angle elements and each defining first and second ends, a pair of wheel supports, each connected to one of said center couplers, a pair of pivot supports connected to said first ends and to said toy vehicle body, a gear rack having opposed ends and a plurality of gear teeth, a pair of pivoting couplers each connected to one of said opposed ends of said gear rack and one of said second ends of said U-shaped steering segments, and a rotatable steering wheel having a gear engaging said plurality of teeth of said gear rack.

* * * * *